US006983836B2

(12) United States Patent
Adams et al.

(10) Patent No.: US 6,983,836 B2
(45) Date of Patent: Jan. 10, 2006

(54) MACHINE AND METHOD FOR CASH RECYCLING AND CASH SETTLEMENT

(75) Inventors: Thomas P. Adams, Oconomowoc, WI (US); Jon R. Stieber, Oconomowoc, WI (US); Robert L. Zwieg, Watertown, WI (US)

(73) Assignee: De La Rue Cash Systems Inc., Watertown, WI (US)

( * ) Notice: Subject to any disclaimer, the term of this patent is extended or adjusted under 35 U.S.C. 154(b) by 80 days.

(21) Appl. No.: 10/411,561

(22) Filed: Apr. 10, 2003

(65) Prior Publication Data

US 2004/0200690 A1 Oct. 14, 2004

(51) Int. Cl.
*G07D 7/00* (2006.01)

(52) U.S. Cl. ..... 194/302

(58) Field of Classification Search ..... 194/302, 194/215, 216, 217; 235/7 A, 379, 380; 902/8, 902/9, 11

See application file for complete search history.

(56) References Cited

U.S. PATENT DOCUMENTS

| | | | | |
|---|---|---|---|---|
| 5,366,404 | A | 11/1994 | Jones | |
| RE37,662 | E | 4/2002 | Uchida et al. | |
| 2001/0013541 | A1 * | 8/2001 | Modi | 235/379 |
| 2001/0034203 | A1 | 10/2001 | Geib et al. | |
| 2002/0030101 | A1 | 3/2002 | Inoue et al. | |
| 2002/0156734 | A1 | 10/2002 | Yamamoto | |
| 2003/0111395 | A1 * | 6/2003 | Aas et al. | 209/534 |
| 2004/0040820 | A1 * | 3/2004 | Adams et al. | 194/216 |
| 2004/0188221 | A1 * | 9/2004 | Carter | 194/215 |
| 2004/0231956 | A1 * | 11/2004 | Adams et al. | 194/217 |

FOREIGN PATENT DOCUMENTS

| | | | |
|---|---|---|---|
| DE | 3431205 | A1 | 5/1985 |
| EP | 0 744 719 | A2 | 11/1996 |
| WO | WO 01/040907 | A2 | 6/2001 |
| WO | WO 02/21460 | A2 | 3/2002 |
| WO | WO 02/47043 | A2 | 6/2002 |
| WO | WO 02/071349 | A2 | 9/2002 |

OTHER PUBLICATIONS

De La Rue company brochure titled "TCR Twin Safe", copyright 2001.
PCT International Search Report dated Nov. 9, 2004.

* cited by examiner

*Primary Examiner*—Donald P. Walsh
*Assistant Examiner*—Mark J. Beauchaine
(74) *Attorney, Agent, or Firm*—Quarles & Brady LLP

(57) ABSTRACT

A cash recycling machine (11) is connected in a network with a computer (10) and other recycling equipment (12), the cash recycling machine (11) having an input device (18) for receiving cash, a sorter (31) for sorting the cash into a plurality of hopper assemblies (26–29), a controller (21) responsive to inputs from a user in a first operating cycle of the machine to cause the hopper assemblies (26–29) to dispense an amount of sorted cash to a cash drawer and to store the amount of dispensed cash in memory in association with a user account number, the controller (21) being responsive to input of a batch of cash and the user account number in a second cycle to count the cash received, and to compare the amount of cash received with the amount of cash dispensed to determine a net amount of cash associated with the user. The controller (21) has the ability to track transactions of employees through the work shift for reconciliation at the end of the work shift and to report results to a central accounting computer.

18 Claims, 9 Drawing Sheets

MACHINE AND METHOD FOR CASH RECYCLING AND CASH SETTLEMENT

TECHNICAL FIELD

The present invention relates to cash handling systems, and more particularly to desktop cash handling equipment for tracking and reconciling cash for multiple cashiers or multiple cash handling employees over a work shift.

DESCRIPTION OF THE BACKGROUND ART

Cash settlement for retail establishments is often handled in a back room or other service area, where cashiers or other employees load and empty cash register drawers and count and record amounts of cash taken and returned by the cashiers. The comparison of cash taken with cash returned is often referred to in banking as "cash settlement." This can also be referred to as balancing or reconciliation. Cash settlement in back rooms of retail establishments has often required separate calculations and record-keeping. While some cash settlement systems have been provided for banks in which personal computers have been connected to cash handling machines, there has not been a convenient and compact machine available for retail establishments.

In recent years, advances have been made in cash handling equipment by making the equipment smaller so that it can be used on a desktop while retaining many of the functions of larger machines typically used in banks.

Geib et al., U.S. patent application Ser. No. 2001/0034203 published Oct. 25, 2001, shows a small coin sorter for filling a coin tray with coins counted by the machine. This allows a cashier to empty a till (also referred to herein as a cash drawer) into the sorter and have the amount counted. It is also possible to empty a batch of coins into the machine for counting as they are deposited in the till.

Various types of cash recycling machines have been known including ATM machines and large cash handling machines for gaming operations. ATM machines have generally been limited to dispensing change, cash withdrawals in the form of bills, or pre-rolled rolls of coin. The large cash handling machines for gaming establishments sort the change into bins, which must then be emptied. Change dispensers and small point-of-sale (POS) recyclers have also been known for dispensing change in multiple denominations to a retail customer via a single device such as a change cup, for example, where the denominations are mixed together.

There remains a need for a compact, bulk cash recycling machine to track cash receiving and dispensing operations for multiple employees over a work shift and to reconcile the amounts received with the amounts originally dispensed—by employee—and record the difference. The machine should have the ability to sort cash by denomination, store cash by denomination and dispense multiple denominations simultaneously, while keeping the denominations separate from each other. This is so that the cashiers will receive batches of cash in a sorted condition. The device should have networking capability with other automated cash handling equipment, for handling notes as well as coins, and with central accounting computers for reporting accounting totals. Such networking capability could utilize wires or be wireless.

SUMMARY OF THE INVENTION

The invention provides a cash recycling machine for dispensing batches of coins and/or notes representing a cashier's operating batch or a till's worth of coins and/or notes, which is less than the entire batch of coins and notes held by the machine, but is greater than an amount of change that would be dispensed to a retail customer.

The machine has the ability to track transactions for multiple employees through the work shift and reconcile accounts for multiple employees at the end of the work shift ("perform cash settlement"). The machine may take the form of a coin dispenser or a note dispenser, with programming and configuration capabilities being provided by a separate device, such as a personal computer.

In contrast to point-of-sale coin recyclers and change dispensers, the bulk cash recycling machine of the present invention dispenses to employees rather than to retail customers. The machine sorts cash by denomination, stores cash by denomination and dispenses multiple denominations simultaneously, while keeping the denominations separate from each other. Thus, the cashiers or employees receive batches of cash in a sorted condition. In addition, the machine may have a specialized port for receiving a cash drawer or till for receiving multiple denominations simultaneously.

The cash recycling and settlement machine of the present invention can include a card reader or a touch screen to receive employee ID information, which grants access to the machine and allows tracking of employee accounts during the work shift. The machine can handle cash and accounting for many employees. The cash recycling and settlement machine of the present invention may perform a cash receiving operation and a cash dispensing operation over a common task-sharing time period.

The machine can provide monitoring, accounting and cash settlement functions. The cash handling machine can be connected to other machines and computers via network communications which can utilize wires or be wireless.

Other objects and advantages of the invention, besides those discussed above, will be apparent to those of ordinary skill in the art from the description of the preferred embodiments which follows. In the description, reference is made to the accompanying drawings, which form a part hereof, and which illustrate examples of the invention.

DETAILED DESCRIPTION

Figure 1:
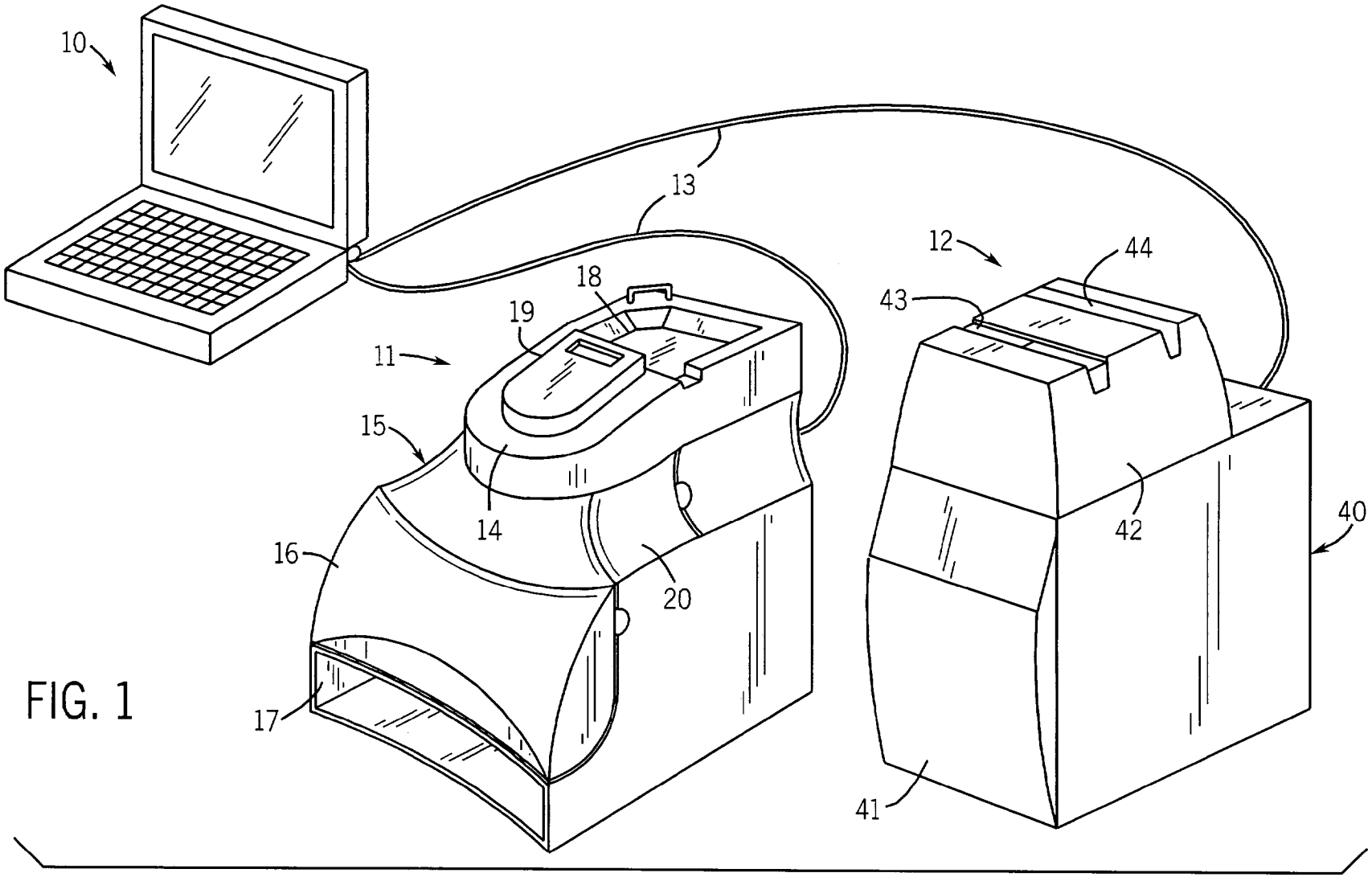
FIG. 1 is a perspective view of a cash recycling machine of the present invention connected in a network with a personal computer and a note recycling machine.

FIG. 1 shows a networked cash management system with automatic cash handling equipment in accordance with the present invention. The system comprises a system control unit 10, which may be a personal computer, and a plurality of cash handling devices 11, 12, which communicate with the system control unit 10 through a wired network 13. The cash handling devices 11, 12 include a desktop coin recycling machine 11 and a note recycling machine 12. The note recycling machine 12 shown is the TCR Twin Safe™ note recycling machine offered commercially by the assignee of the present invention. This is a floor standing unit. It will accept notes at eight notes per second and will dispense notes at up eight notes per second.

Figure 5:
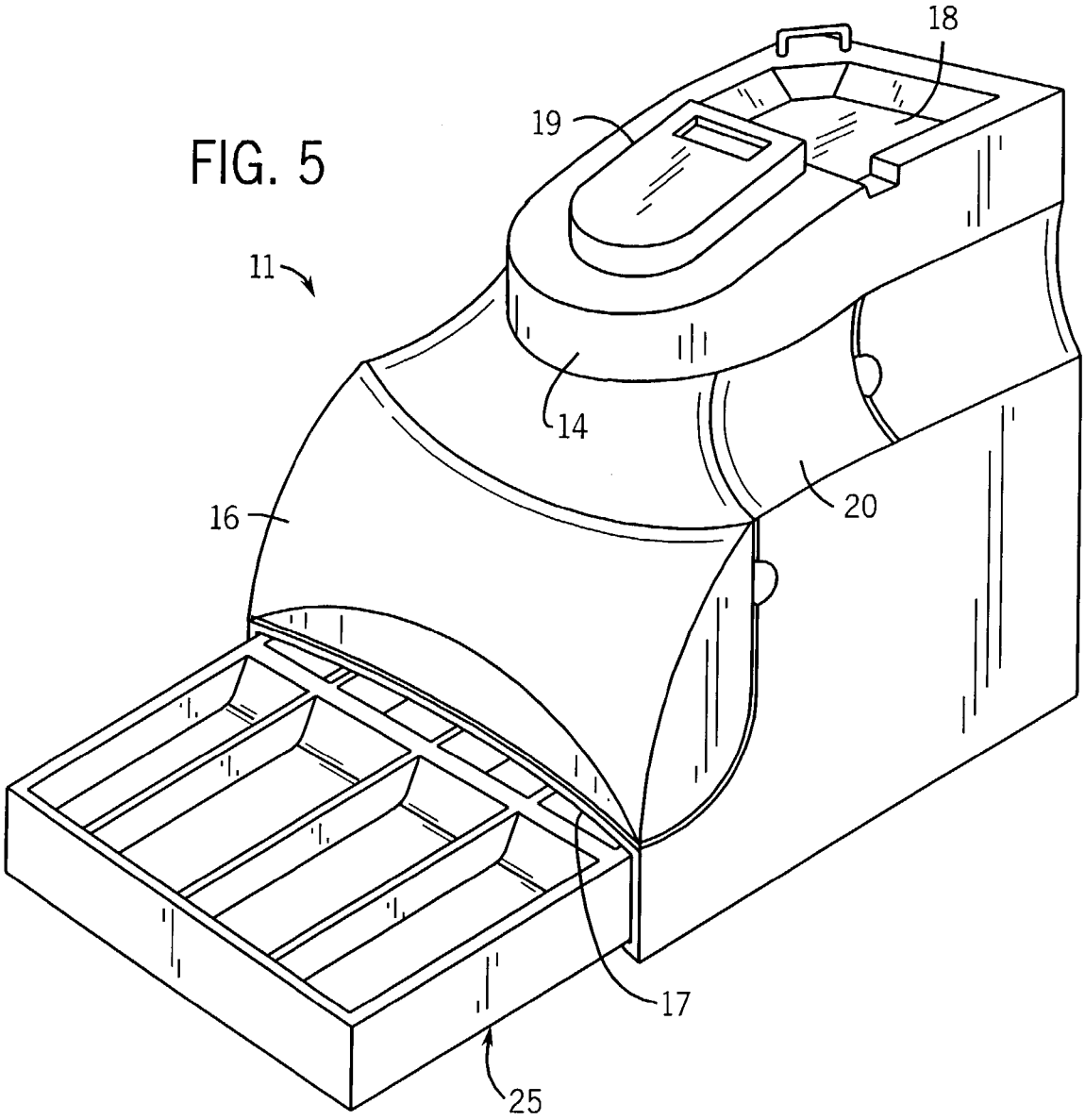
FIG. 5 is a perspective view of the cash recycling machine seen in FIG. 1, showing a cash till being inserted into an opening in the housing.

The coin recycling machine 11 has a housing 15 with a front door 16 and an open slot 17 for receiving a cash drawer 25 (as seen in FIG. 5). A machine input hopper 18 is provided for receiving batches of coins. A card reader 19 with a display is mounted on the top 14 of the housing in front of the hopper 18. A removable chute 20 is tucked under the top panel 14 of the housing 15 above the front door 16.

The note recycling machine 12 also has a housing 40 including a front door 41 for access to a cash drawer assembly hidden in the interior of the machine. A top cover 42 has two slots 43, 44, one for receiving notes and one for dispensing notes. Both the coin recycler 11 and the note recycler 12 are connected to a personal computer 10 by wires 13 for network communication of data.

Figure 2:
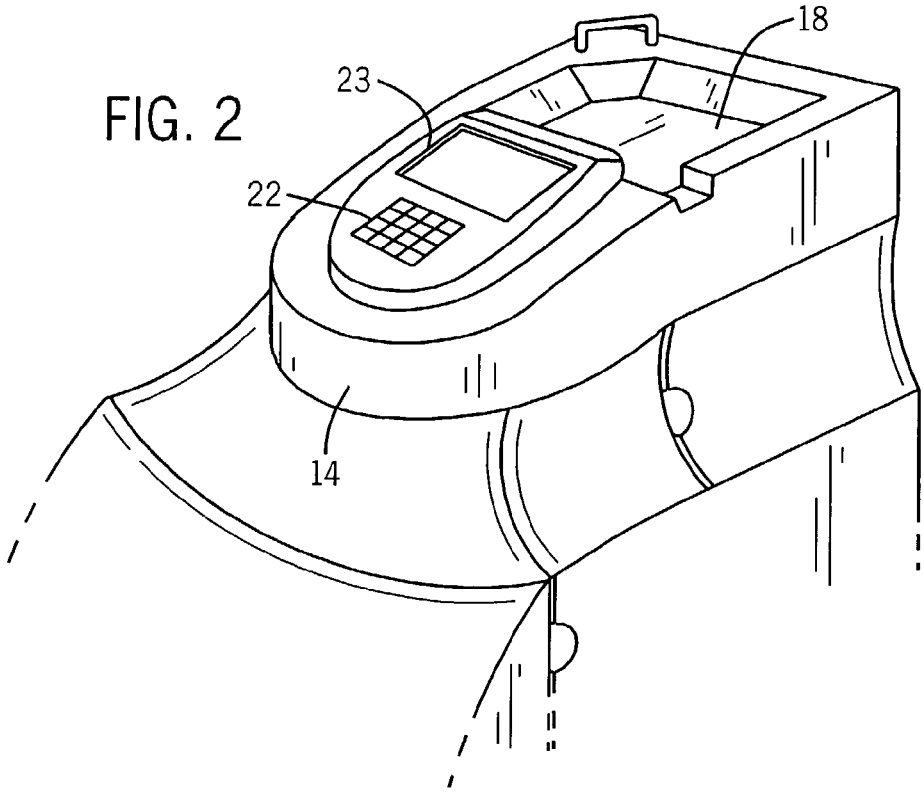
FIG. 2 is a detail view of a cash recycling machine seen in FIG. 1 having a control panel with a keypad and display.
Figure 3:
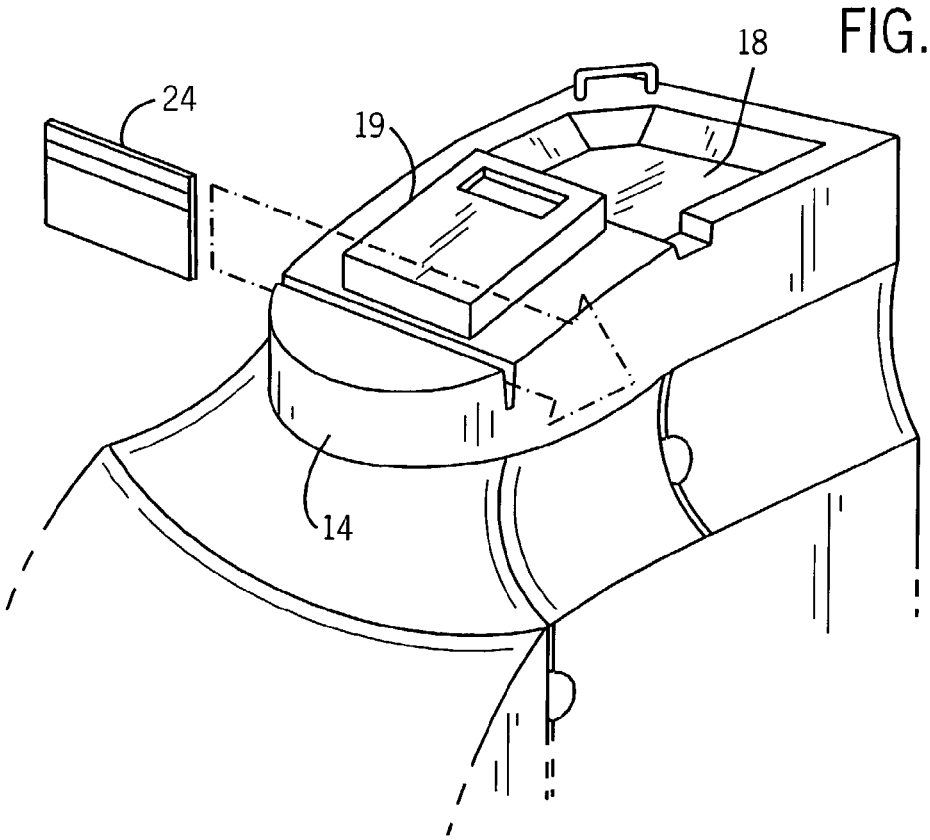
FIG. 3 is a detail view of a cash recycling machine seen in FIG. 1, showing a card reader input device instead of the keypad/display.

Referring next to FIG. 2, the note recycler 11 is controlled through a built-in controller 21 (FIG. 7) having a keypad 22 and a display or touch screen 23 (FIG. 2) and circuitry (not shown). Additional programming and data storage capabilities can be provided, however, by communicating with the coin recycler from the laptop computer 10. As seen in FIG. 3, it is advantageous and convenient to provide a card reader 19 for scanning ID cards 24 of the employees to allow access and operation of the coin recycler. It would also be possible to employ a system of passwords and ID numbers which would be entered using the keypad 22 of FIG. 2.

Figure 4:
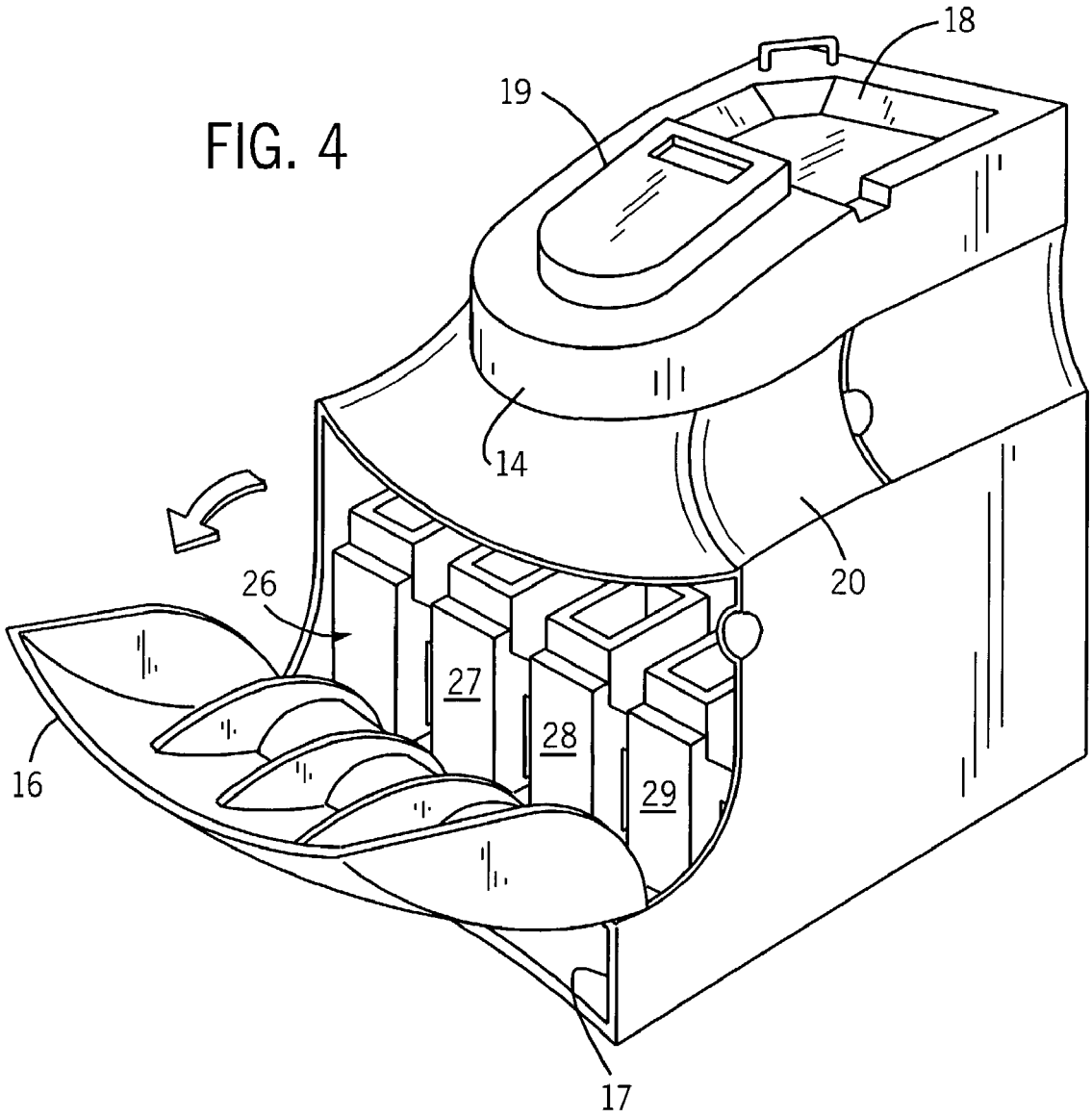
FIG. 4 is a perspective view the cash recycling machine seen in FIG. 1, showing the opening of a front door of the housing.
Figure 6:
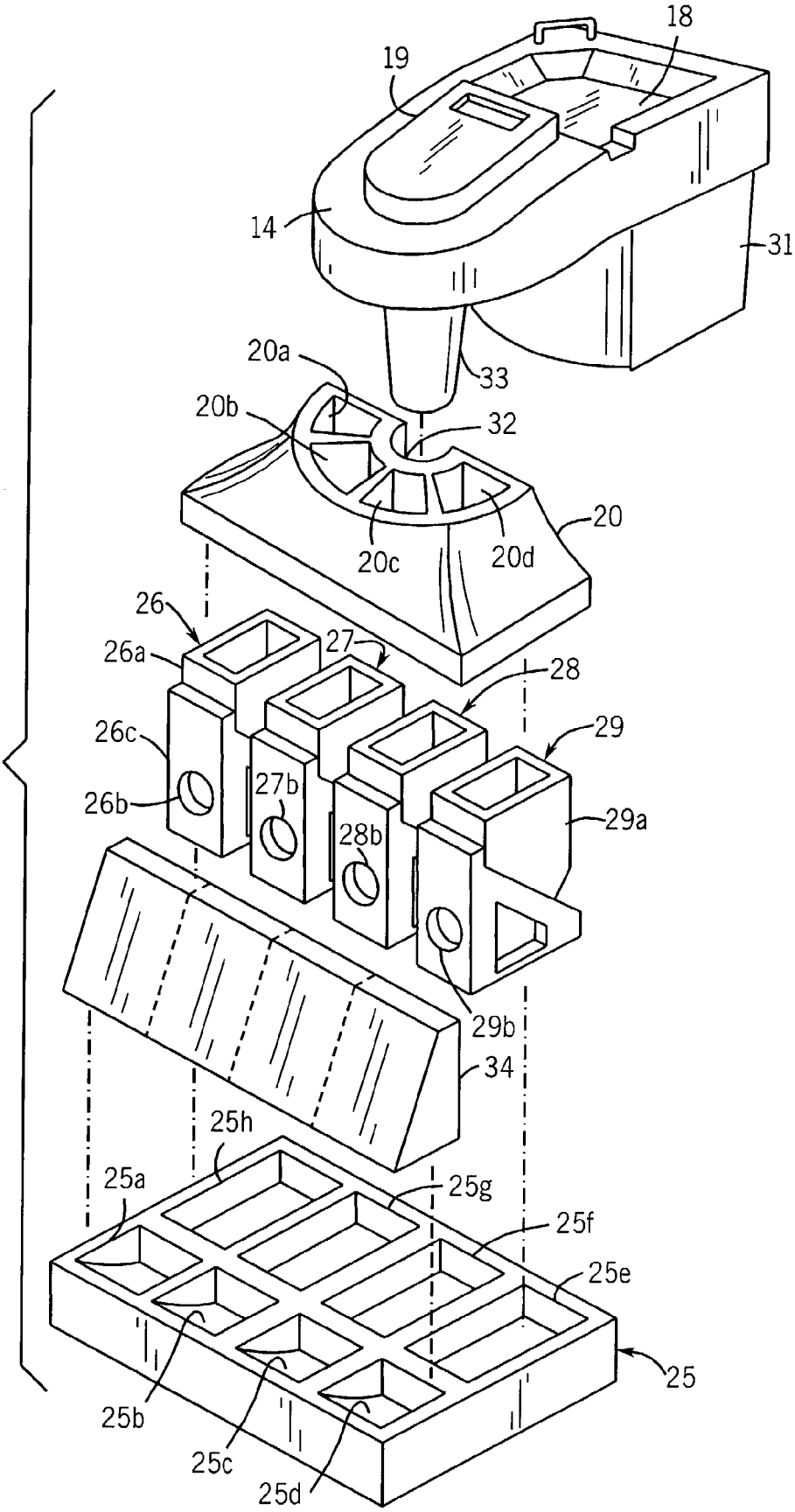
FIG. 6 is an exploded perspective view of the cash recycling machine of FIGS. 1, 3, 4 and 5.
Figure 7:
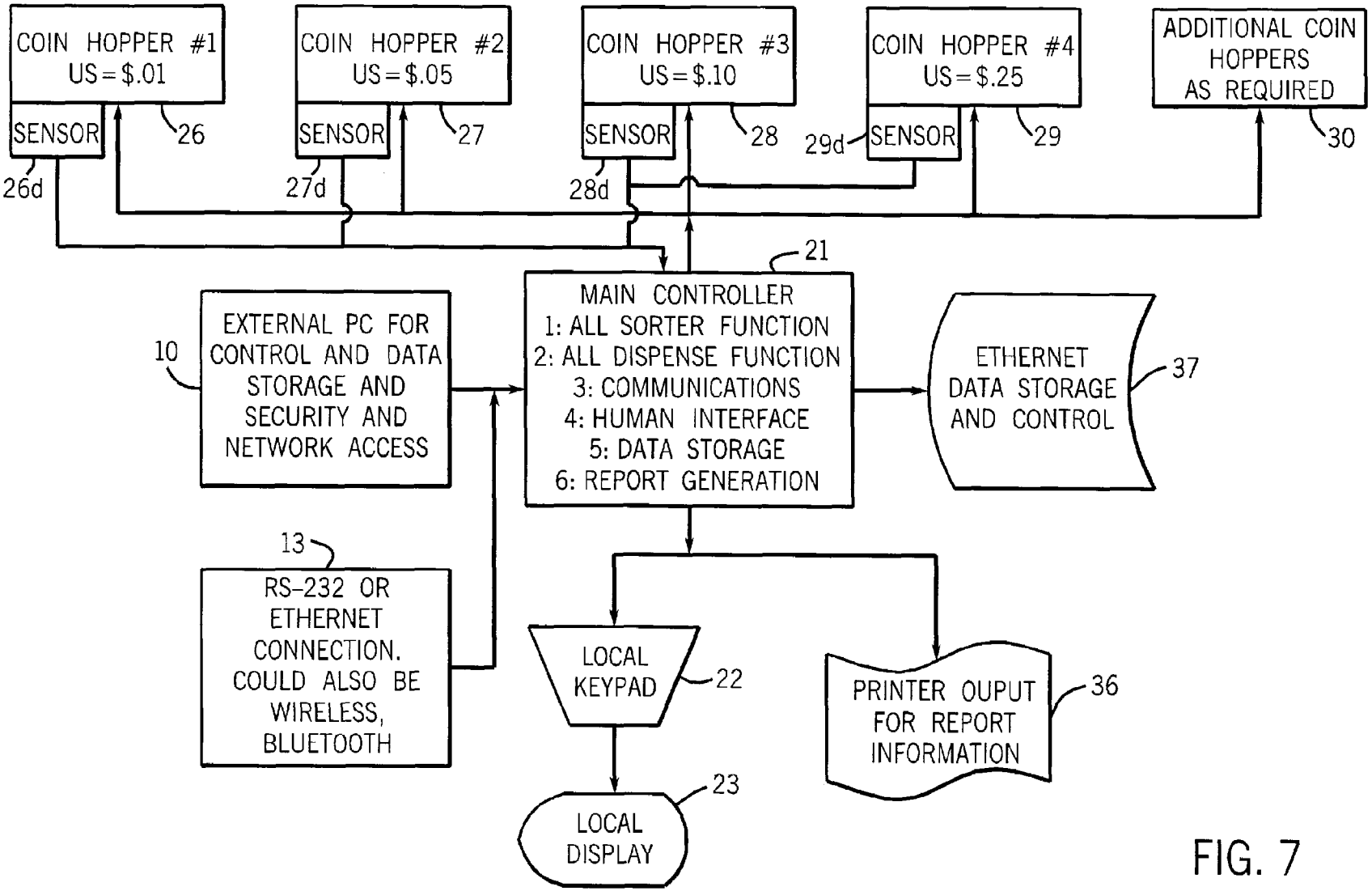
FIG. 7 is a functional block diagram of the system of FIG. 1.

Referring next to FIGS. 4, 6 and 7, the coin recycler includes at least four modular coin hopper assemblies 26, 27, 28 and 29. As illustrated in FIG. 7, these might be provided for coins of four respective denominations, in the U.S. for example, one-cent coins, five-cent coins, ten-cent coins and twenty-five-cent coins. Additional hopper assemblies 30 (FIG. 7) can be provided for half-dollar coins and dollar coins. The machine 11 will also handle coin sets of other countries. Each hopper assembly, such as assembly 26, includes a receptacle 26*a* with at least one coin exit port 26*b*, a hopper supporting frame 26*c* and a coin counter/sensor 26*d* (FIG. 7). Hopper assemblies as shown in Uchida et al., U.S. Re. Pat. No. 37,662 are suitable for this purpose. The hopper assemblies are accessible through a pivotable door 16 on the front of the housing 15 as seen in FIG. 4.

Referring again to FIG. 6, there is a first removable coin chute 20, which in this instance has four channels 20*a*–20*d* for directing the coins from a coin sorter 31 to the four respective receptacles 26*a*–29*a*. This chute 20 has an integral cylindrical half section 32 for fitting around a tapering cylindrical post 33 depending from the top portion 14 of the housing 15. Also seen in FIG. 6 is a second removable coin chute 34 for directing coins in channels from the exits of the respective hopper assemblies 26*a*–29*a* to compartments 25*a*–25*d* in the cash drawer 25. The cash drawer 25 also has compartments 25*e*–25*h* for bills or notes.

Referring now to FIG. 7, a block diagram of the system (less the note recycler) illustrates the hopper assemblies 26–30 which are connected for sensing and control to a controller 21 in the coin recycling machine 11. This controller 21 will control the coin sorter 31, control the dispensing of coins from hopper assemblies 26–30, control network communications and input and output of date through the keyboard, display and card reader (human interface). In addition, the controller 21 stores data and generates reports through suitable I/O devices such as a printer 36. Such a controller 21 would include a CPU, a program memory for storing a control program, data memory and suitable I/O circuitry, including network interface circuitry such as Ethernet interface circuitry 37, RS-232 interface circuitry 13 and/or Bluetooth™ RF interface circuitry for wireless communication. The controller 21 can also be used to maintain database information related to completed transactions, malfunctions and system errors, machine usage, and other data. The controller 21 receives commands from the personal computer 10, the keypad 22 or the card reader 19 which determines the function of the machine (e.g., accept coin through the sorter, dispense coin out of the hoppers, get data from control).

Figure 8:
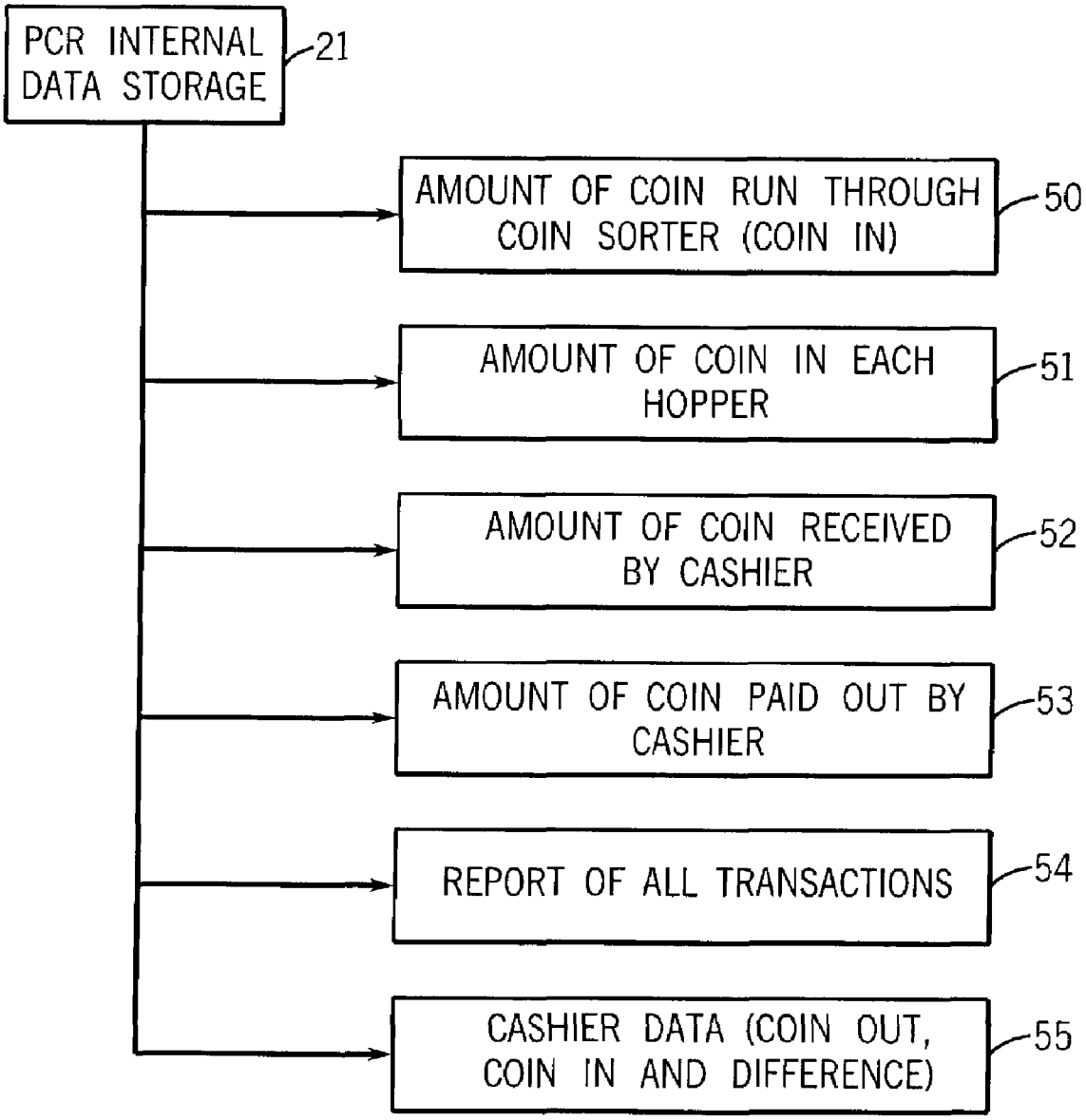
FIG. 8 is a block diagram of data stored in a memory in the machine of FIG. 1.

FIG. 8 shows the type of data that is stored in the controller and available to the personal computer 10 or other computer through the network 13. The first block 50 represents storage for an amount of coin run through the coin sorter (coin in). The second block 51 represents storage for an initial amount and operating level of coin of a denomination in each respective hopper assembly 26–29. The next block 52 represents storage for an amount of coin received of a denomination in each respective hopper assembly 26–29. The next block 53 represents storage for an amount of coinage dispensed to a cash drawer as shown in FIG. 5. The next block 54 represents a report of all transactions for each employee for each work shift. The last block 55 represents a cash settlement or reconciliation showing the differences between cash dispensed to each employee versus cash input from each employee. The results represented by the last two blocks 54, 55 can be transmitted to a central accounting computer through a suitable network.

Figure 9:
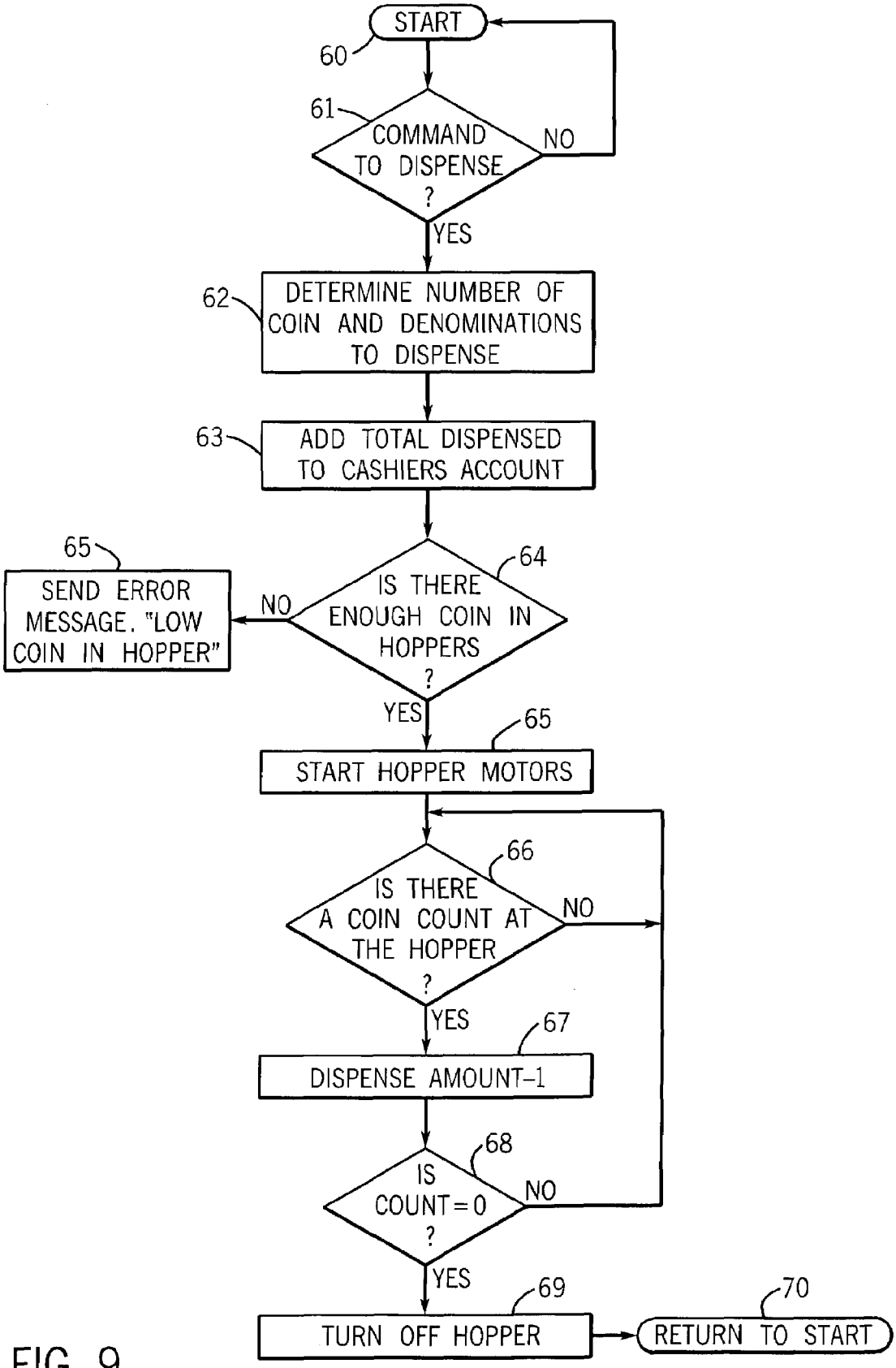
FIG. 9 is a block diagram of the initial dispense operation for dispensing cash to a till of an employee at the start of a work shift.

Referring next to FIG. 9, a cash input operation to the coin recycling machine begins as represented by start block 60 in FIG. 9. The blocks in the flow chart correspond to groups of one or more program instructions which can be executed by the controller to carry out the described operations. On start-up, the coin hopper assemblies 26–29 will require a starting balance of coin to satisfy initial dispensing commands. Bulk coin is fed into the machine hopper 18. It is then sorted into the individual coin denomination receptacles 26–29. The machine controller 21 stores the value of the coinage denominations which are available for dispensing into empty cash drawers 25.

When a cashier reports for work, he or she needs to fill his or her cash drawer or till to start the day. The machine is waiting in a loop for a dispense command as represented by decision block 61 in FIG. 9. A dispense command represented by the "Yes" result from decision block 61 is received from a remote device or from the keypad 22 or card reader 19 and coin is dispensed into the till. Pennies, dimes, nickels and quarters are dispensed into compartments 25*a*–25*d* in the cash drawer or till 25. From the cashier's sign-on through the keypad 22 or card reader 19, a known amount of coin will be assigned to the employee account as represented by process blocks 62, 63.

As represented by decision block 64, a check is then made to see if there is a minimum amount of coin in the hopper assemblies. If the answer is "NO," a "LOW COIN" message is displayed on the display 23 or sent to a remote device as represented by process block 65. Since most retail stations are net consumers of coin, the hopper assemblies 26–29 may run low of coin and require more. The low coin message informs the attending employee that the machine needs more coin of at least one and maybe more denominations.

If the answer from executing decision block 64 in FIG. 9 is "YES," signifying sufficient supply of coins, then hopper assembly motors (not shown) are started and the sensor/counters 26*d*–29*d* on the assemblies 26–29 are used to count the amount of coin that is dispensed, as represented by blocks 65–69. When the amount to be dispensed equals zero, the controller 21 turns off the motors and the routine returns to the wait loop at the start as represented by connector 70.

If, during the work shift, an employee needs more coinage, the cashier can sign on the machine 11 and request more coinage of all or of individual denominations. The coinage is then charged to the employee's account.

If one or more of the coin hoppers are getting too full, a message will be transmitted to the display or controlling device. This message will indicate that at least one of the hoppers assemblies 26–29 is full. The operator should then enter a command to dispense a number of coins in that hopper to reach a normal operating level.

Figure 10:
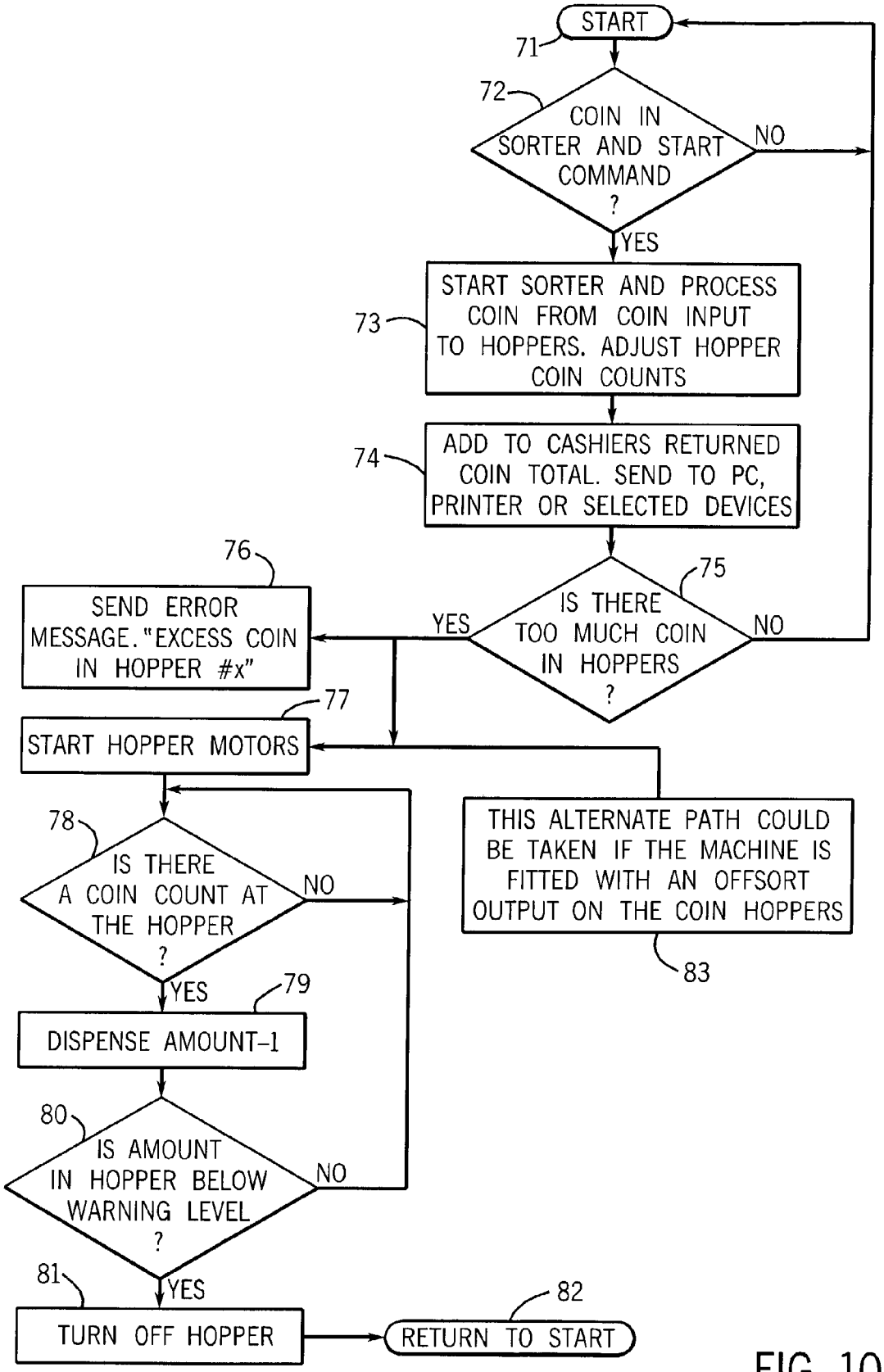
FIG. 10 is a block diagram of a cash input operation from an employee during, or at the end of, a work shift.

At the end of the employee's shift, the employee will sign on through the control panel 14 and initiates a "BALANCE" or "RECONCILE" operation. Referring to FIG. 10, when the employee returns cash during a work shift, the cash is deposited in the hopper, the employee inputs an ID or account number with the keypad or by using the card reader, and the machine is started to sort the coins and store them in the hoppers as represented by the "YES" result from decision block 72. Otherwise the machine is in a wait loop back to the start block 71 as represented by the "NO" result from decision block 72. The sorter then sorts the coins and stores coins of respective denominations in the respective hopper assemblies 26–30. The amount deposited is counted by sensors (not shown) on the coin sorter as the coins are sorted. These amounts will be added to the amounts already stored in the hopper assemblies 26–29. The deposited amount is stored in the controller memory along with the user account number as represented by process block 74. All of this information can also be sent as data to a local computer 10 or to a central accounting computer via the network 13.

Next, a subroutine comprising blocks 75–82 is executed to check the level of the coin hoppers. If there is too much coinage in one or more hoppers, a message is sent to the display. Also, the hopper motors are started to discharge excess coinage as represented by blocks 77–81. The machine then returns to the start block 71 as represented by connector block 82, to await the next batch of coins received from a user.

The coin recycling machine 10 can also be connected to a note recycler 11 and can send dispense commands to dispense notes and receive data representing amounts of notes deposited in the note recycler 11. This allows the tracking of both coins and notes for various employees. The controller 21 of the present invention can also be provided in a note recycler for tracking notes dispensed to an employee and notes received from an employee, using a card reader and note denomination receptacles as described for the coin recycling machine. It will be apparent to those of ordinary skill in the art that other modifications might be made to these embodiments without departing from the spirit and scope of the invention, which are defined by the following claims.

We claim:

1. A cash recycling machine for receiving cash, for sorting cash into a plurality of denominations and for dispensing cash as a plurality of unmixed denominations, the machine comprising:

a housing;

a cash input area on the housing for receiving a batch of cash deposited in the machine;

a sorting mechanism for sorting a batch of cash deposited in the machine into a plurality of denominations;

a plurality of receptacles for storing the cash by denomination after sorting, said receptacles being operable to dispense said cash as a plurality of unmixed denominations;

a plurality of denomination sensors positioned with respect to the respective receptacles for sensing the amounts of denominations stored in the respective receptacles and for sensing amounts of the denominations dispensed from the respective receptacles; and a controller responsive to the denomination sensors and responsive to inputs from a user in a first operating cycle of the machine to cause the receptacles to dispense an amount of cash as a plurality of unmixed denominations and to store the dispensed amount of cash in memory in association with a user account number, the controller being responsive to input of a batch of cash and the user account number in a second cycle to count the cash received, and to compare the amount of cash received with the amount of cash dispensed to determine a net amount of cash associated with the user.

2. The cash recycling machine of claim 1, wherein the housing has a cash drawer receiving area adapted to receive a cash drawer having multiple compartments; and wherein the cash is dispensed into the multiple compartments of the cash drawer in a the first operating cycle while maintaining the denominations in a sorted and separated condition.

3. The cash recycling machine of claim 1, wherein the controller includes memory for storing a plurality of user accounts with a balance per user of cash received and cash dispensed.

4. The cash recycling machine of claim 1, further comprising:

a card reader input device electrically connected to the controller for transferring inputs from a plurality of users to the controller; and wherein the controller associates inputs from a plurality of users with cash balances of cash dispensed and received for respective users.

5. The cash recycling machine of claim 1, further comprising a touch screen input device electrically connected to the controller for transferring inputs from a plurality of users to the controller; and wherein the controller associates inputs from a plurality of users with cash balances of cash dispensed and received for respective users.

6. The cash recycling machine of claim 1, wherein the cash comprises coins.

7. The cash recycling machine of claim 6, further comprising a first chute for directing coins received from the cash input area to the plurality of receptacles and a second chute for directing coins from the receptacles to the cash drawer receiving area.

8. The cash recycling machine of claim 1, further comprising a network interface circuit for interfacing the controller with a network.

9. The cash recycling machine of claim 8, wherein the network is a wired network.

10. The cash recycling machine of claim 8, in combination with a computer and a note recycling machine connected to the network, wherein the cash recycling machine is a coin recycling machine.

11. The cash recycling machine of claim 1, wherein the housing includes a front door for opening to access the receptacles which are removable from the housing.

12. A method of recycling cash during a work shift, comprising:

responding to inputs from a user in a first operating cycle of a machine to cause an amount of cash to be dispensed as a plurality of unmixed denominations at a corresponding plurality of locations;

storing the amount of dispensed cash in memory in association with a user account number, which is one of the inputs from the user;

responding to inputs from a user and a batch of cash put into the machine in a second operating cycle of the machine to total the cash put into the machine and to store the cash in receptacles by denomination; and comparing the amount of cash received in the second operating cycle with the amount of cash dispensed in the first operating cycle to determine a net amount of cash associated with the user account number.

13. The method of claim 12, wherein the cash is dispensed into multiple compartments of a cash drawer in the first operating cycle while maintaining the denominations in a sorted and separated condition.

14. The method of claim 12, further comprising transmitting a balance of cash associated with the user account number to a central accounting computer.

15. The method of claim 12, further comprising storing balances of cash dispensed compared with cash received for a plurality of users.

16. The method of claim 12, further comprising comparing the amount of cash stored in the receptacles by denomination with a predetermined minimum level and transmitting a low coin message to a display when the cash in one or more of the receptacles is less than the predetermined minimum level.

17. The method of claim 12, further comprising comparing the amount of cash stored in the receptacles by denomination with a predetermined maximum level and transmitting an excess coin message to a display when the cash in one or more of the receptacles is more than the predetermined maximum level.

18. A method of recycling cash during a work shift, comprising:

responding to inputs from a user in a first operating cycle of a machine to cause an amount of cash to be dispensed;

storing the amount of dispensed cash in memory in association with a user account number, which is one of the inputs from the user;

responding to inputs from a user and a batch of cash put into the machine in a second operating cycle of the machine to total the cash put into the machine and to store the cash in receptacles by denomination;

comparing the amount of cash received in the second operating cycle with the amount of cash dispensed in the first operating cycle to determine a net amount of cash associated with the user account number; and further comprising transmitting inputs from the user in a first operating cycle to a second machine to dispense notes from the second machine along with coins from the first machine and transmitting data from the second machine to the first machine when notes are deposited in the second machine.

* * * * *